United States Patent [19]

Hinchcliffe et al.

[11] 4,201,507

[45] May 6, 1980

[54] APPARATUS FOR HANDLING ROD-LIKE ARTICLES

[75] Inventors: Dennis Hinchcliffe; Frank Heybourn; Eric A. Luddington, all of London, England

[73] Assignee: Molins Limited, England

[21] Appl. No.: 786,493

[22] Filed: Apr. 11, 1977

Related U.S. Application Data

[63] Continuation-in-part of Ser. No. 622,709, Oct. 15, 1975, Pat. No. 4,078,648.

[30] Foreign Application Priority Data

Apr. 15, 1976 [GB] United Kingdom ..... 15750/76
Jul. 28, 1976 [GB] United Kingdom ..... 31362/76

[51] Int. Cl.[2] ..... B65G 1/00

[52] U.S. Cl. ..... 414/331; 198/347; 198/778; 414/285

[58] Field of Search ..... 214/16 B, 309, 310; 198/347, 778; 53/148, 236; 414/222, 266, 278, 285, 287, 331

[56] References Cited

U.S. PATENT DOCUMENTS

| | | | |
|---|---|---|---|
| 2,591,202 | 4/1952 | Ruark | 53/236 |
| 2,726,753 | 12/1955 | Bee | 198/347 |
| 2,933,872 | 4/1960 | Pollmann | 53/148 |
| 3,024,585 | 3/1962 | Schubert et al. | 53/148 |
| 3,508,669 | 4/1970 | Cook | 198/347 |
| 3,817,369 | 6/1974 | Bluthardt et al. | 198/347 |
| 3,869,115 | 3/1975 | Barkley | 198/778 |
| 3,895,479 | 7/1975 | Kastner | 53/148 |
| 4,030,595 | 6/1977 | McCombie | 198/347 |
| 4,078,648 | 3/1978 | Hinchcliffe | 198/347 |

FOREIGN PATENT DOCUMENTS 2636163 2/1977 Fed. Rep. of Germany ..... 198/347

OTHER PUBLICATIONS

Research Disclosure No. 132 of Apr. 1975, p. 14.

*Primary Examiner*—Lawrence J. Oresky
*Attorney, Agent, or Firm*—Craig and Antonelli

[57] ABSTRACT

A mobile reservoir for rod-like articles is adapted for connection into a static conveyor system, e.g. through a reversible elevator, and includes conveyor means for moving the articles within the reservoir. The conveyor means may be arranged to move and store the articles in the reservoir as a continuous stream. In a preferred arrangement the conveyor means includes a number of conveyors defining at least one zig-zag path extending substantially in a constant plane normal to the axes of the articles. In another arrangement the articles are stored and moved in batches: in this case the articles are also delivered to the reservoir in batches, e.g. by a conveyor provided with divider plates.

31 Claims, 19 Drawing Figures

APPARATUS FOR HANDLING ROD-LIKE ARTICLES

Figure 1:
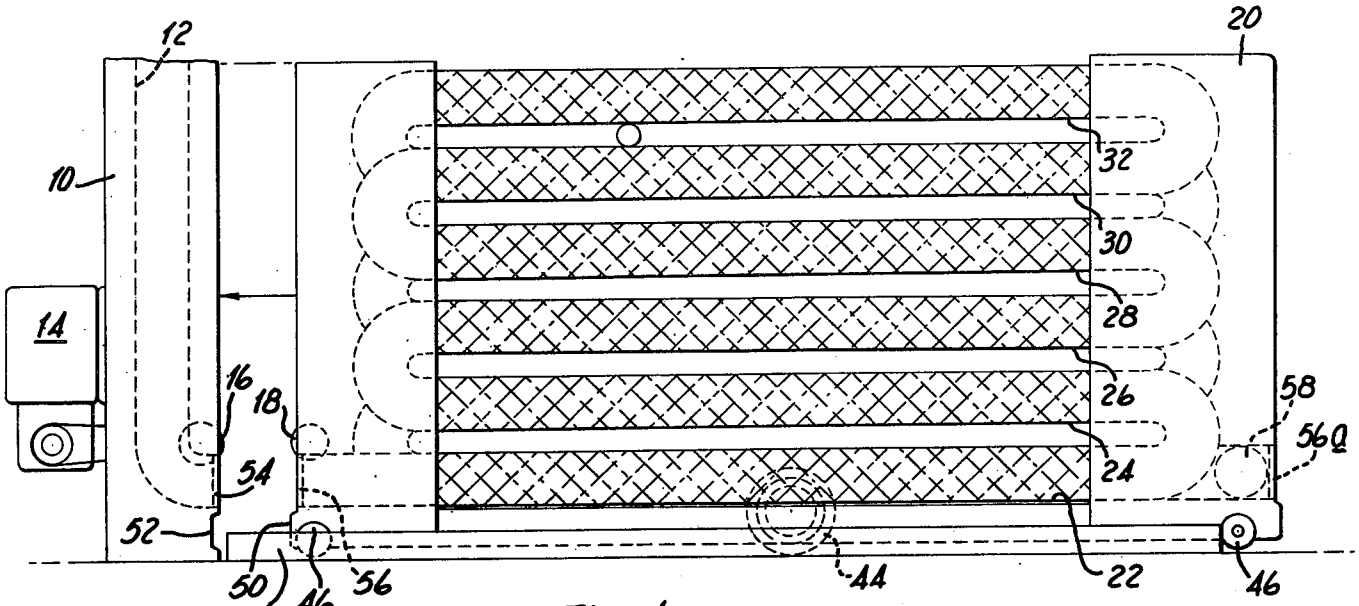

This application is a continuation-in-part of our prior copending application Ser. No. 622,709, filed Oct. 15, 1975, now U.S. Pat. No. 4,078,648 issued Mar. 14, 1978.

This invention is concerned with apparatus for conveying and storing rod-like articles such as cigarettes or cigarette filter rods.

It is often desirable to provide temporary storage facilities for rod-like articles. For example, in the transport of cigarettes from a cigarette making machine to a cigarette packing machine a buffer store may be provided so that if either of the machines is stopped the other may continue in operation for some time. Where several such machine complexes are in operation it may be that in one complex the making machines consistently produce more than their associated packers can accept whereas in another complex the makers cannot keep the packers fully occupied. In these circumstances it can be useful to accept cigarettes from the one complex and deliver them to the other complex. U.S. Pat. No. 3,967,740 describes suitable systems for storing and moving rod-like articles in trays.

One aspect of the present invention provides a reservoir for rod-like articles including means for receiving a stack of rod-like articles delivered from a supply in a direction transverse to the lengths of the articles; conveyor means for conveying the articles as a stack within the reservoir; means for supporting the reservoir so that it is mobile; and means for storing and retaining the articles in the reservoir so that it may be separated and move away from said supply.

The reservoir preferably includes at least one inlet adapted for connection to a supply comprising a static conveyor system for rod-like articles and means for closing the inlet so that the reservoir can be moved away after filling. The outlet from the static conveyor system should also have closure means. Both openings could be closed by insertion at their junction of a pair of stream separators, one of which is arranged to remain attached to the opening of the conveyor system whereas the other remains attached to the reservoir opening. The conveyor means of the reservoir preferably includes drive means adapted for connection to drive means associated with the supply conveyor system.

The conveyor means may be reversible. The reservoir may include an inlet to the conveyor means and an end stop for articles on the conveyor means. In this case, in particlar, the conveyor means is preferably reversible so that the inlet may serve also as an outlet. A reservior could include separate conveyor means having independent combined inlet/outlets. In another arrangement the reservoir may have spaced openings connected by the conveyor means, each opening serving as either an inlet or an outlet depending on the direction of movement of the conveyor means. During filling or unloading of the reservoir only one opening is used, the other being blocked. In a preferred way of operating a reservoir having spaced openings the articles are always moved in the same direction so that if the reservoir is filled from one opening it is emptied from the other opening.

The reservoir is mobile preferably by means of wheels supporting the conveyor means. The reservoir could be moved on a track system.

In one preferred arrangement of reservoir the conveyor means comprises a number of conveyors defining a zig-zag path extending substantially in a constant plane normal to the axis of the cigarettes. Thus the present mobile reservoir may be similar to any one of the reservoirs described in our U.S. Pat. No. 4,078,648 the disclosure of which is hereby incorporated herein in full. The conveyor means of the reservoir may comprise two substantially vertical zig-zag conveyor paths arranged alongside one another. These could have a diagonal or other connecting conveyor to form a continuous conveyor path between two openings positioned so that the reservoir is diagonally symmetrical.

An advancing stream of rod-like articles on the conveyor means of a mobile reservoir may be bounded by an end closure device, such as that disclosed in said application, which is inserted in the inlet prior to filling of the reservoir. Where the reservoir is used as a reversible store the same closure device, which is gripped and conveyed by said conveyor means, also serves to confine the end of the stream during emptying. If the reservoir is provided with two openings to the conveyor means the closure device may be fed out of the reservoir to leave the reservoir completely full after a filling operation and may be reinserted when it is required to empty the reservoir. Movable secondary conveyor means may be provided to feed an end closure device into an emptying reservoir.

It is possible that a mobile reservoir according to the present invention could comprise a conveyor means defining a helical path for a stream of rod-like articles, such as that disclosed in British Pat. Specifications Nos. 1,299,174 and 1,299,175.

The receiving means of a reservoir may be arranged to receive the rod-like articles in batches each comprising a stack of the articles, rather than as a continuous stream. In this case the conveyor means is preferably arranged to move and store the articles also in batches. The conveyor means could comprise opposed endless conveyors provided with spaced ledges for supporting each batch. The retaining means for the articles in the reservoir preferably then includes guides which support the ends of a batch on the ledges.

A reversible mobile reservoir could be used to replace the storage unit of the tray system disclosed in U.S. Pat. No. 3,967,740. Similarly separate mobile reservoirs could be appropriately connected into a system such as that disclosed in British Pat. application No. 32394/75 to which reference is directed in its entirety, to replace the tray filling unit and the tray unloading unit.

According to another aspect of the present invention a conveyor system for rod-like articles includes at least one mobile reservoir, delivery means for moving a stream comprising a stack of said articles in a direction transverse to the lengths of the articles, and locating means for locating and guiding a reservoir into position for transfer of rod-like articles between the conveyor means of the reservoir and the delivery means. The delivery means preferably includes output means. The delivery means is preferably reversible, as is said conveyor means, so that rod-like articles may be fed from the reservoir to the delivery means and beyond. The delivery means may include output means, such as a driving connection, for controlling the conveyor means of said reservoir.

The delivery means may be an elevator such as that described in British Pat. Specification No. 1,453,191, to which reference is directed for further details.

Where the mobile reservoir is adapted to receive the articles in batches the delivery means could comprise a conveyor provided with separators for dividing a stream into batches.

The conveyor system may include several delivery means each adapted for connection to a mobile reservoir and each associated with a sensor for controlling drive means for both the delivery means and a reservoir connected to it. The system may also include a fixed permanent reserovir such as that disclosed in British Pat. Specifications Nos. 1,299,174, 1,299,175 or in our U.S. Pat. No. 4,078,648.

The delivery means and the conveyor means of the mobile reservoir may at least in part be controlled by a signal derived from the permanent reservoir. Typically the present conveyor system could form a link between one or more cigarette making machines and one or more cigarette packing machines.

Figure 2:
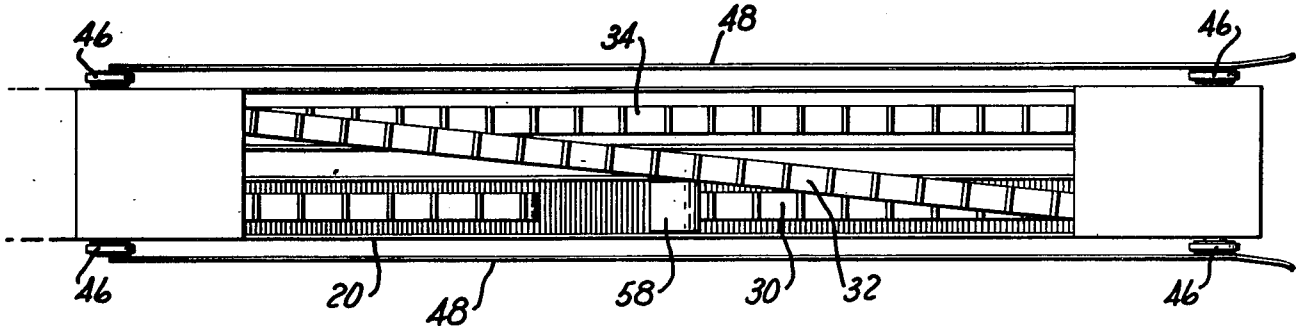
Figure 3:
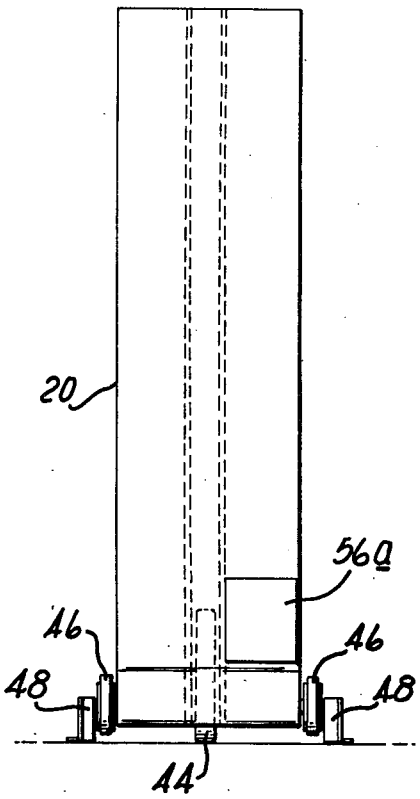
Figure 4:
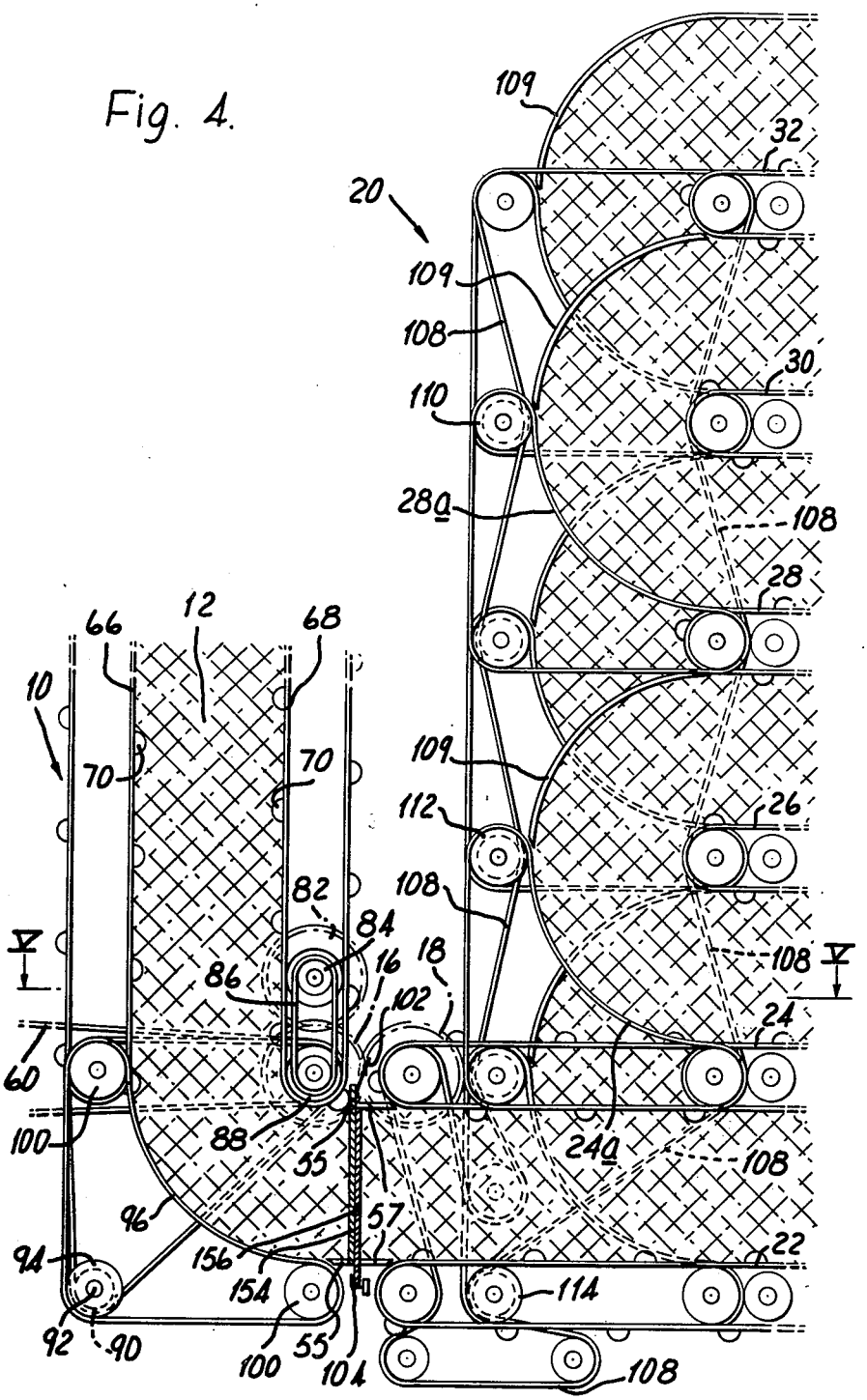
Figure 5:
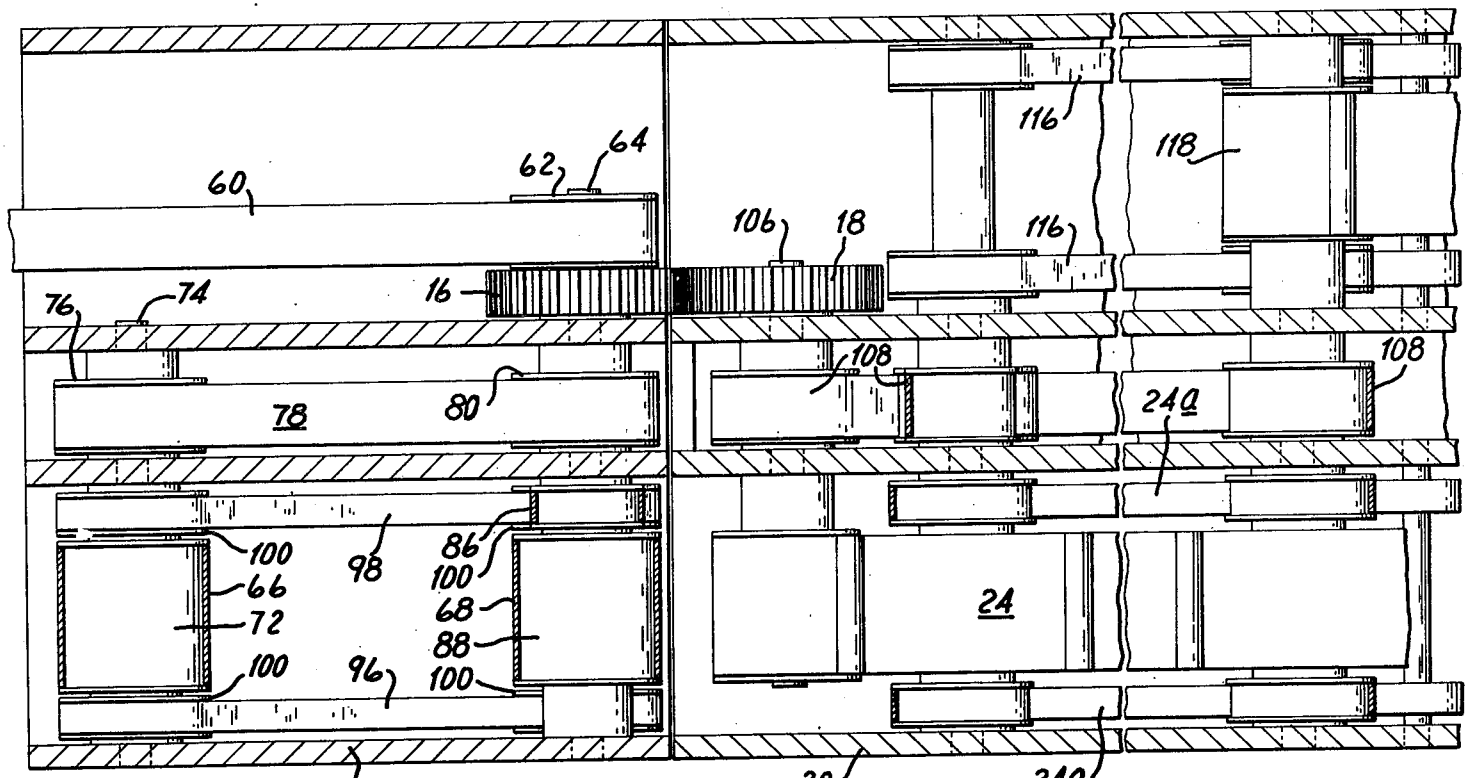
Figure 6:
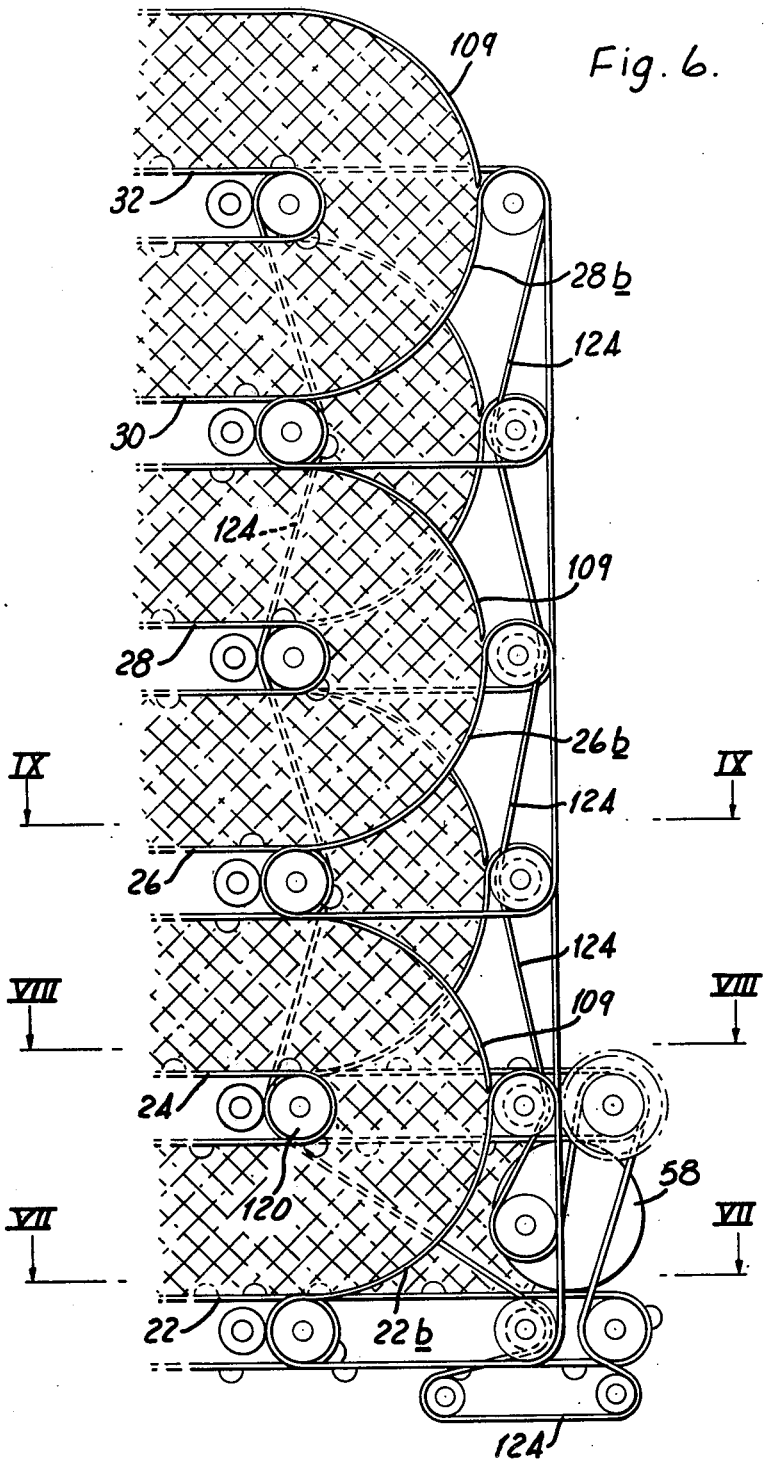
Figure 7:
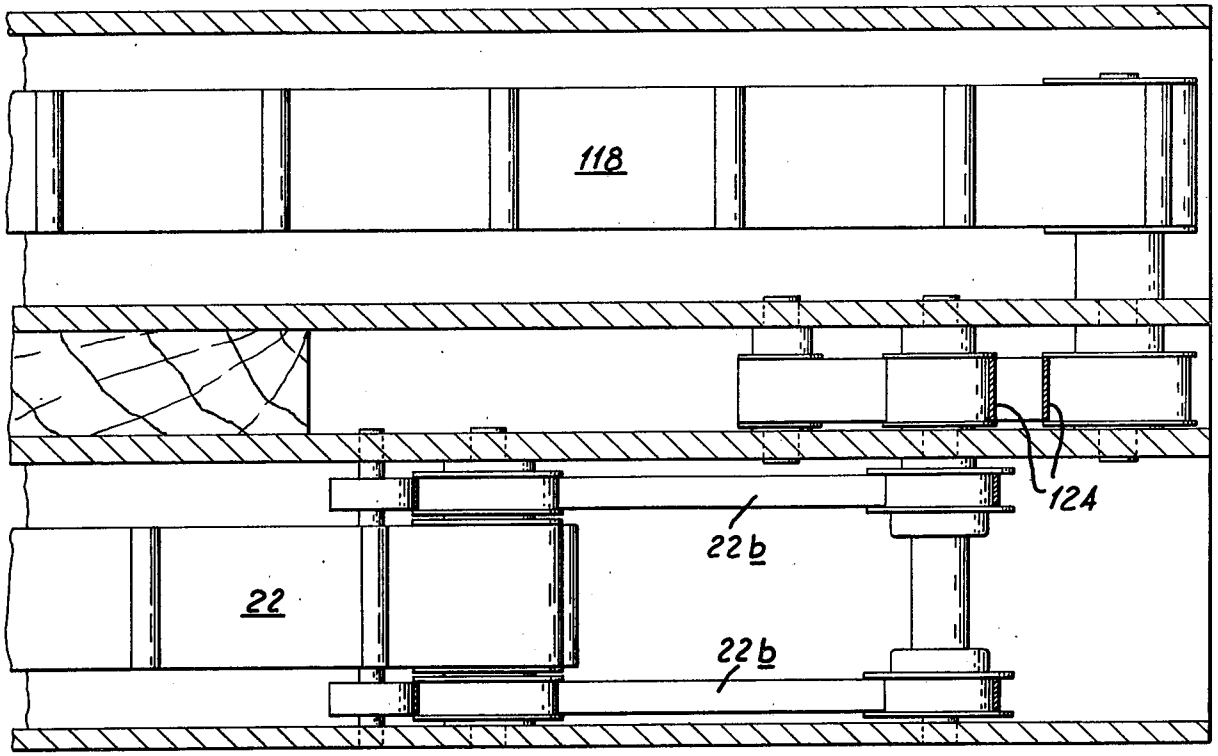
Figure 8:
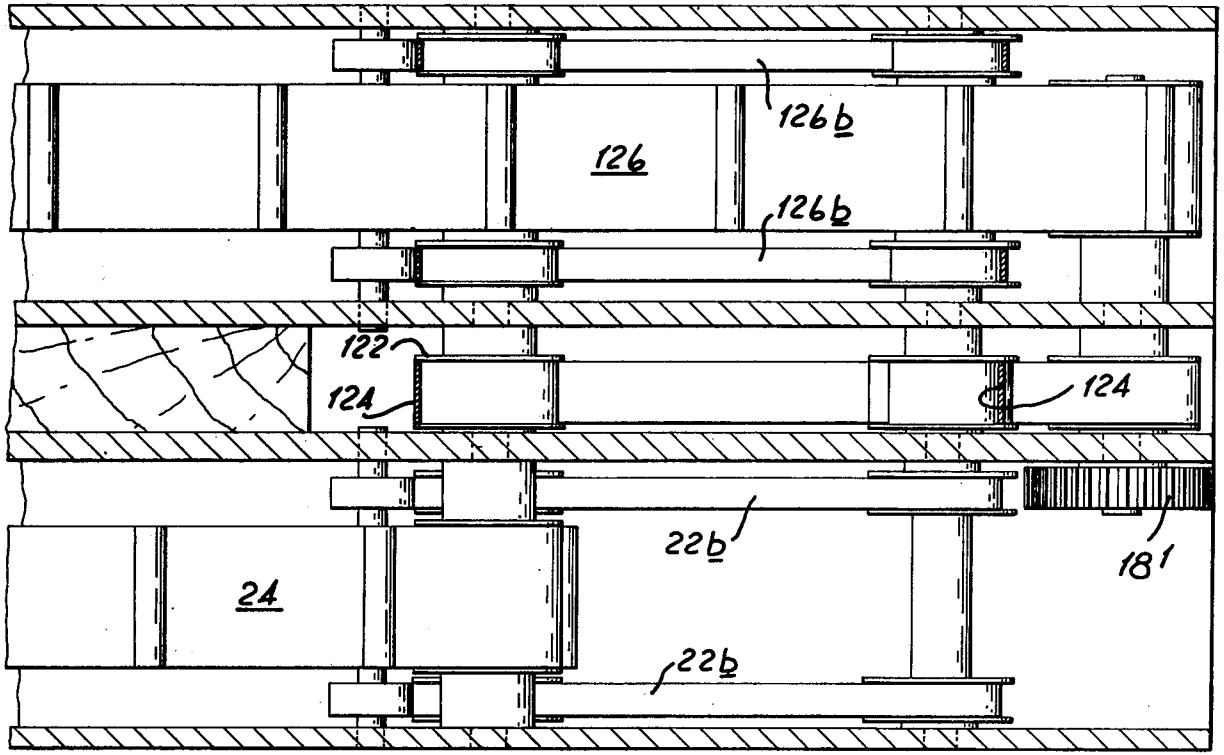
Figure 9:
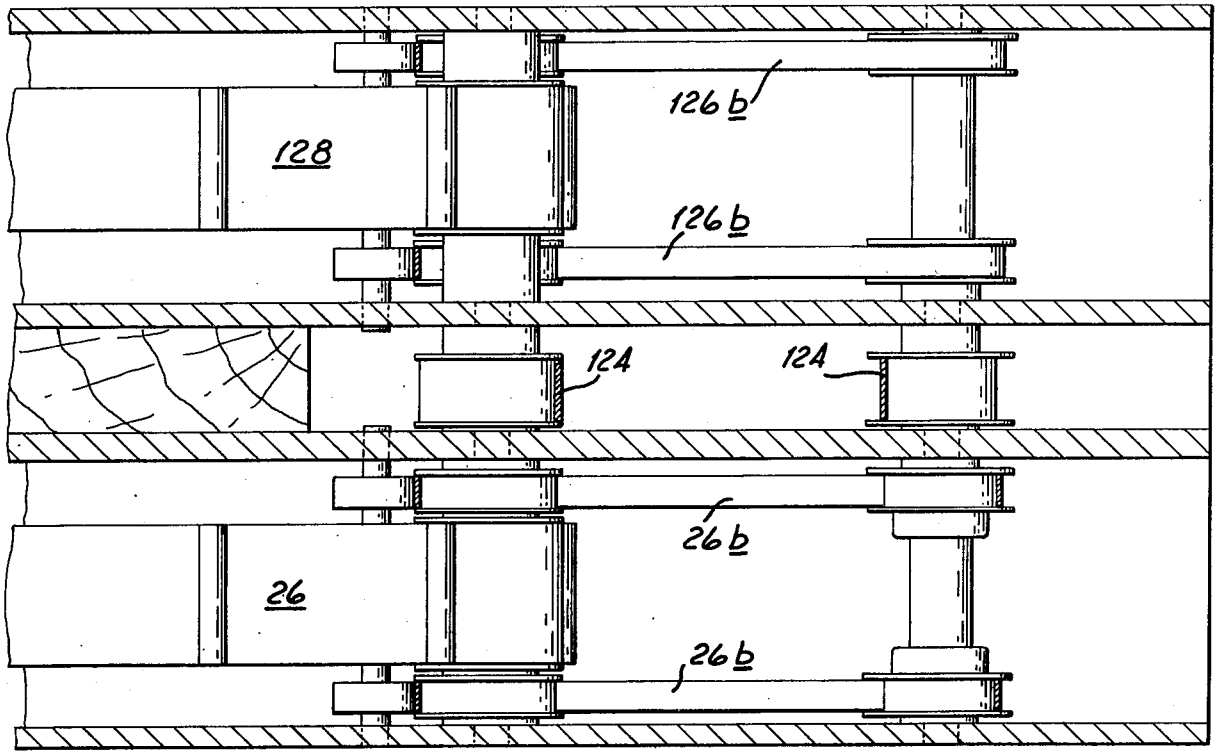
Figure 10:
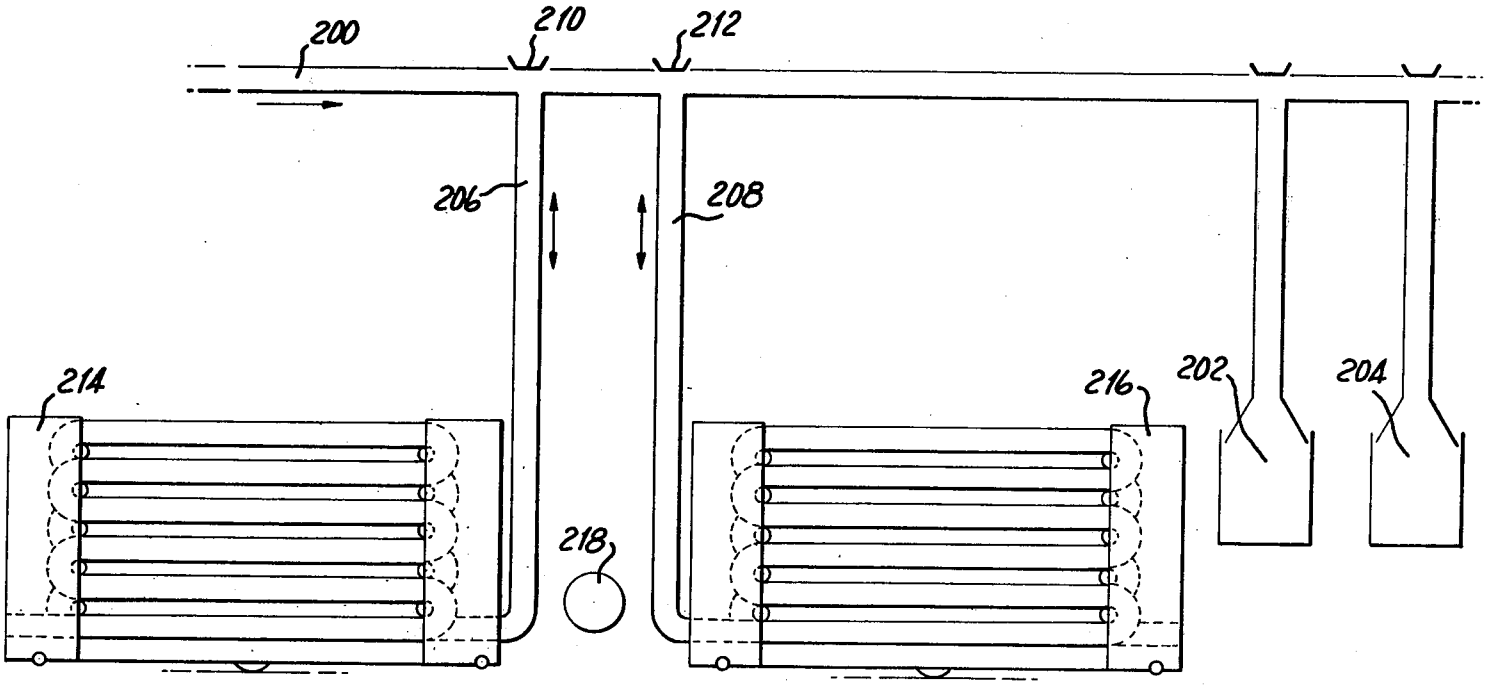
Figure 11:
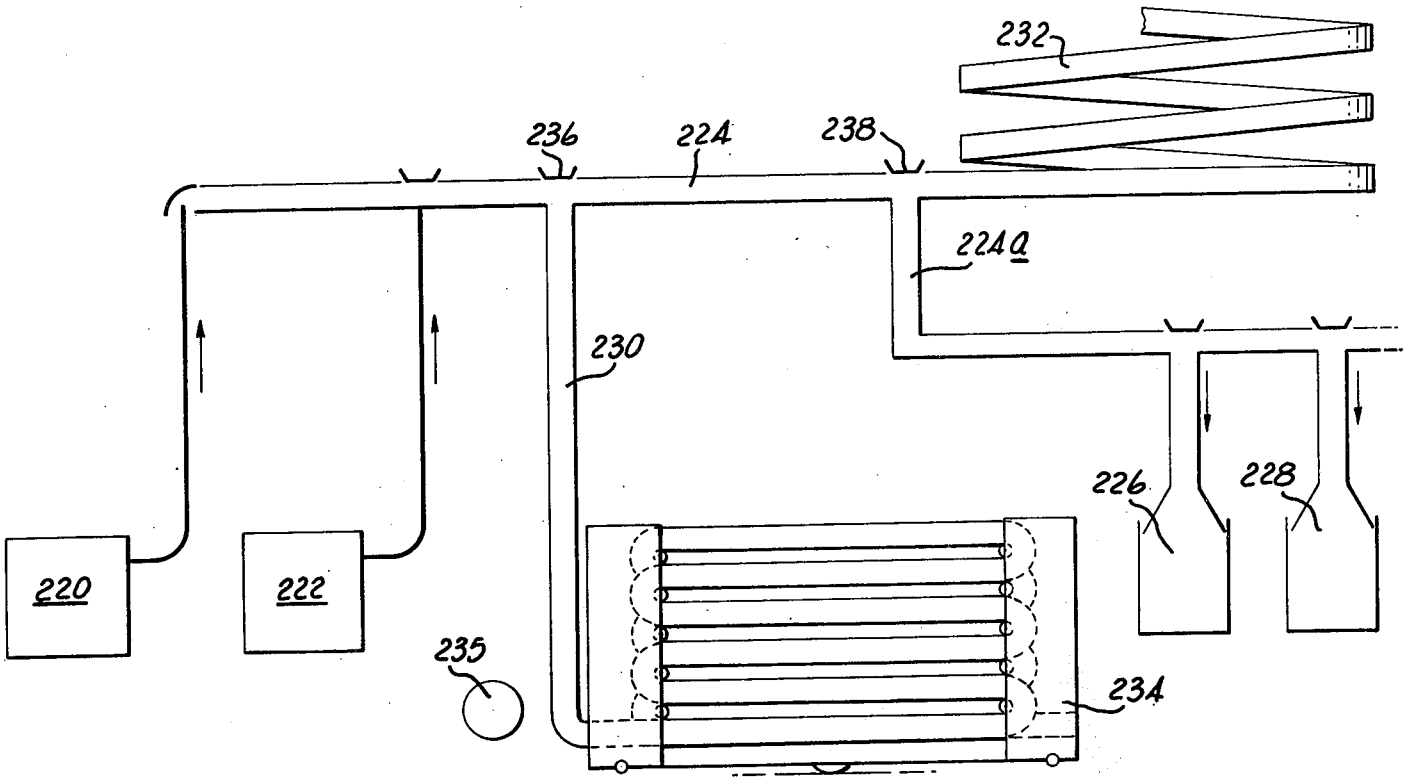
Figure 12:
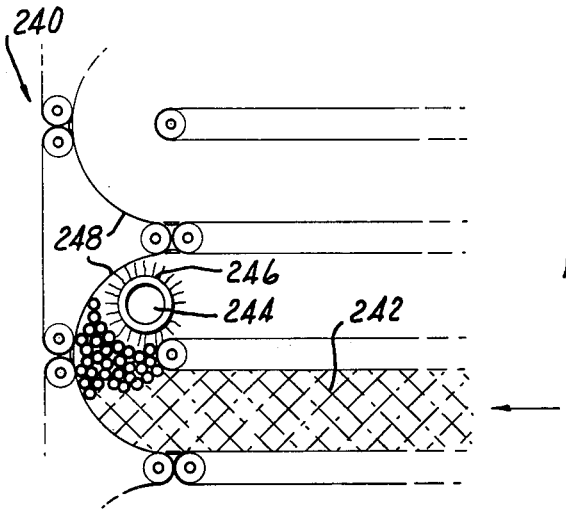
Figure 13:
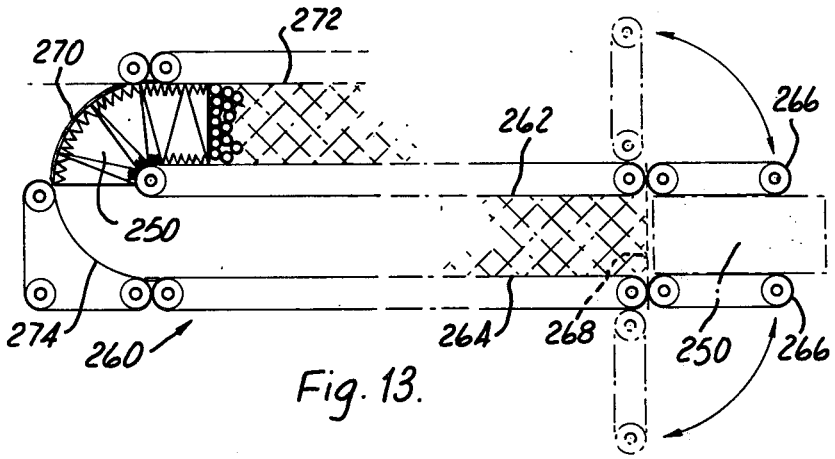
Figure 14:
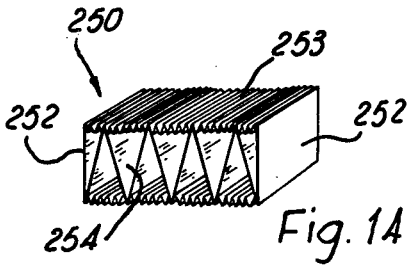
Figure 15:
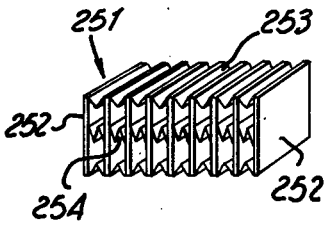
Figure 16:
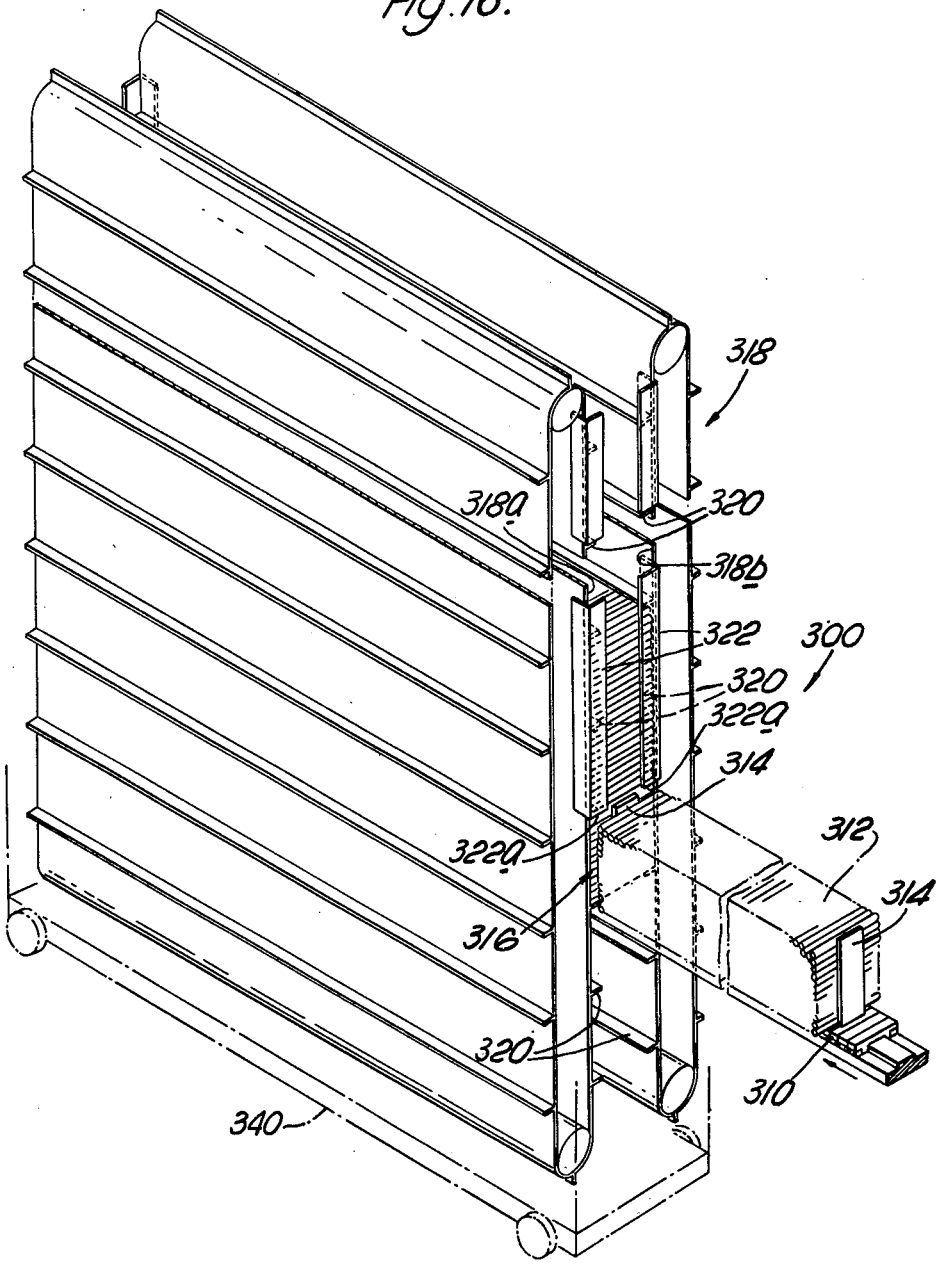
Figure 17:
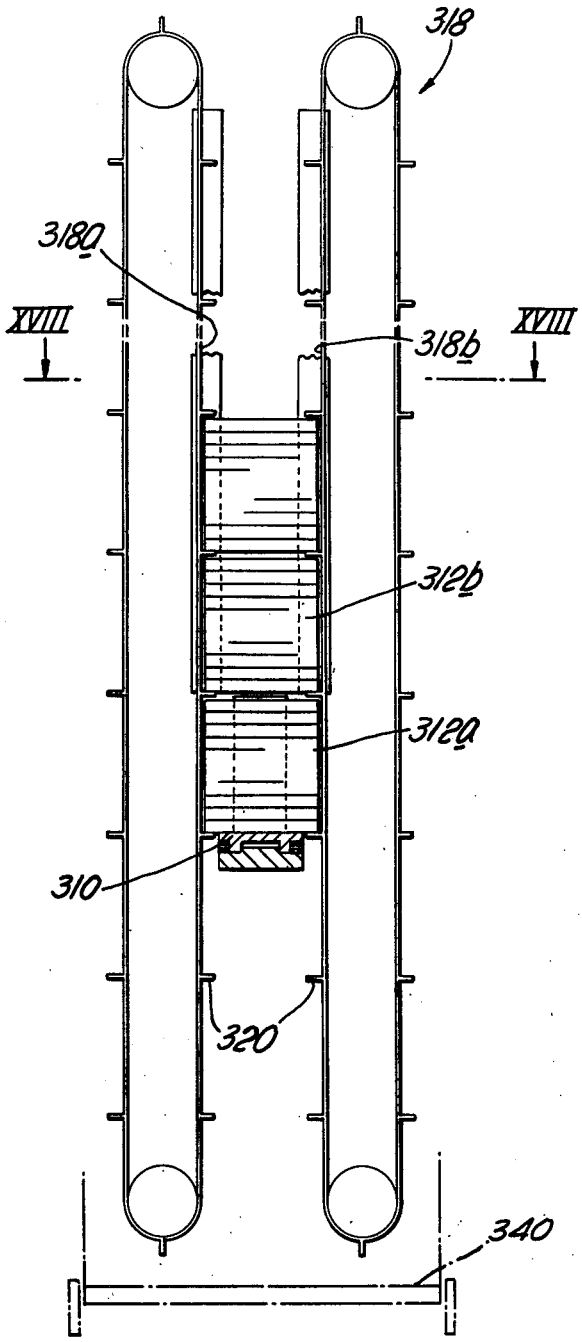
Figure 18:
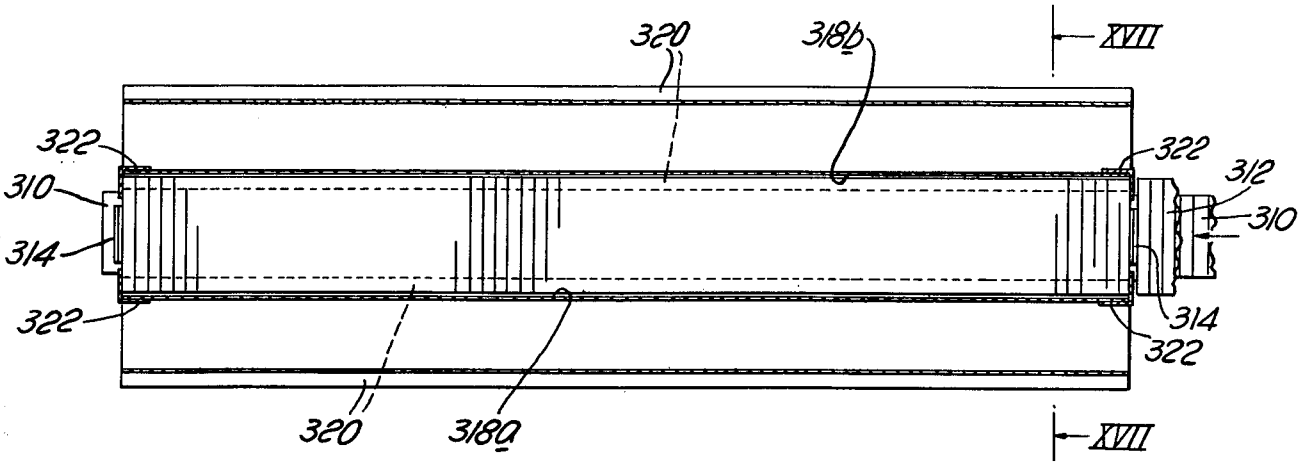
Figure 19:
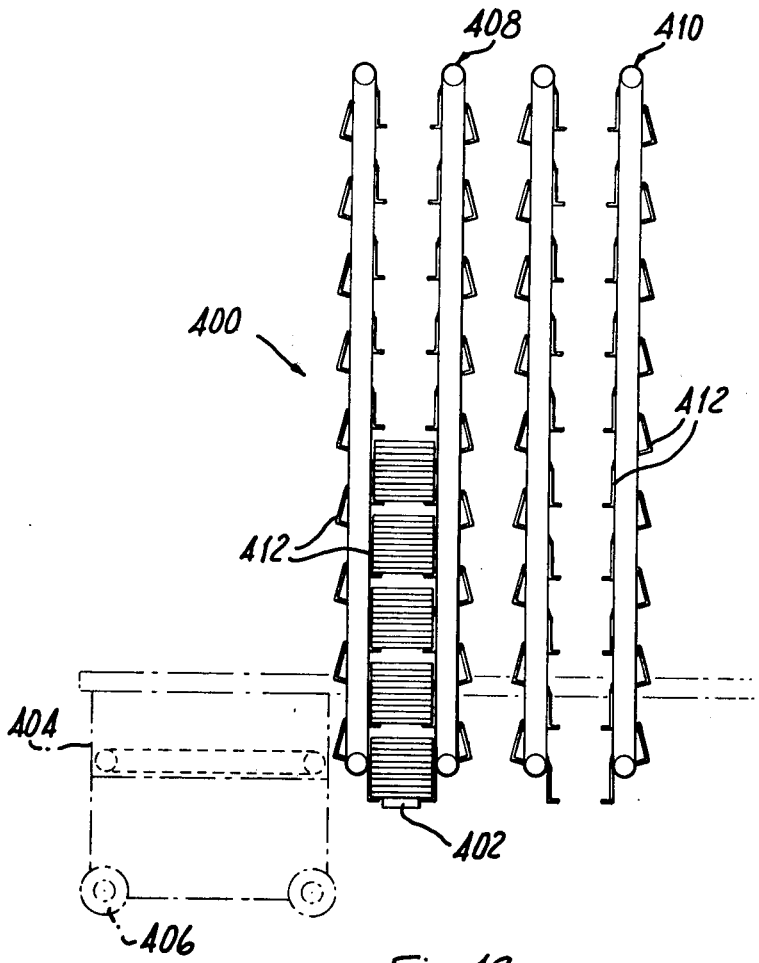

The invention will now be further described, by way of example only, with reference to the accompanying drawings, in which:

FIG. 1 is a diagrammatic side view of apparatus including a mobile reservoir and an elevator for cigarettes, FIG. 2 is a plan view of part of the apparatus of FIG. 1, FIG. 3 is an end view of the apparatus of FIG. 1, FIG. 4 is a vertical sectional view of part of the apparatus shown on the left-hand side of FIG. 1, FIG. 5 is a horizontal section view on the line V—V of FIG. 4, FIG. 6 is a vertical sectional view of the right-hand side of the mobile reservoir shown in FIG. 1, FIG. 7 is a horizontal sectional view on the line VII—VII of FIG. 6, FIG. 8 is a horizontal sectional view on the line VIII—VIII of FIG. 6, FIG. 9 is a horizontal sectional view on the line IX—IX of FIG. 6, FIG. 10 is a diagrammatic side view of a cigarette conveying system incorporating a mobile reservoir, FIG. 11 is a diagrammatic side view of another cigarette conveying system incorporating a mobile reservoir, FIG. 12 shows a detailed modification of part of a mobile reservoir, FIG. 13 is a diagrammatic side view of part of another modified mobile reservoir, showing insertion of an end closure device, FIGS. 14 and 15 are perspective diagrammatic views of end closure devices for use with a mobile reservoir, FIG. 16 is a diagrammatic perspective view of part of an apparatus for handling cigarettes including another mobile reservoir for batches of cigarettes, FIG. 17 is a vertical sectional view through the apparatus of FIG. 16, parallel to the cigarettes and on the line XVII—XVII in FIG. 18, FIG. 18 is a horizontal sectional view on the line XVIII—XVIII of FIG. 17, and FIG. 19 is a diagrammatic end view of a further mobile reservoir for batches of cigarettes.

FIG. 1 shows a reversible elevator unit 10 arranged to convey a stream of parallel cigarettes in stack formation, in a direction transverse to their lengths, along a path 12. The unit 10 may comprise a conveyor system as disclosed in British Pat. Specification No. 1,453,191, to which reference is directed for further details. As described in said specification the elevator unit 10 may be connected to a conveyor system linking one or more cigarette making machines to one or more cigarette packing machines. Attached to the unit 10 is a motor 14 for driving conveyor bands of the elevator as will be described later. The motor 14 may be under control of a sensor associated with the junction of said elevator unit with a further conveyor system, as described for example in British Pat. Specification No. 1,372,148, to which reference is directed, so that the direction and speed of motion of the stream on path 12 is determined by the sensor.

The motor 14 is also connected to a primary drive gear 16 mounted on the unit 10 for connection to a corresponding drive gear 18 of a mobile reservoir 20. The reservoir 20 comprises a movable unit including a series of bands which define an elongated reservoir space extending respectively upwards and downwards along zig-zag paths in parallel vertical planes with a diagonal connecting conveyor at the top. The horizontal runs of the zig-zag path on one side are defined by bands 22, 24, 26, 28, 30 and 32, the band 32 being diagonally disposed to convey a stream across to the zig-zag path on the other side of the reservoir 20, as shown in FIG. 2. There are corresponding bands which define further horizontal runs of the zig-zag path on said other side, the first of these bands 34 also being shown in FIG. 2.

The reservoir 20 is supported on a large central wheel 44 arranged between the two zig-zag paths (see also FIG. 3) and also carries four smaller wheels 46 arranged near its bottom corners. Associated with the elevator unit 10 are parallel guide rails 48 spaced apart by a distance such that the outer edges of the wheels 46 just fit between the rails after an initial lead-in portion of the rails. Thus the reservoir 20 may be moved towards the elevator unit 10 between the rails 48 until a projection 50 on the reservoir is engaged in a recess 52 in the unit 10, in which position the gears 16 and 18 are drivingly engaged. As shown in the drawings some degree of rotation of the reservoir 20 about its mounting on wheel 44 is allowed before the wheels 46 make contact with a level surface supporting the wheel 44: this allows a degree of adjustment in a vertical direction to allow accurate engagement of the reservoir with the elevator unit 10.

When the reservoir 20 is engaged with the elevator unit 10 a stream of cigarettes can flow from or to the path 12. In normal operation the conveyor system of which the path 12 forms a part would be operated so that the path remains full of cigarettes, i.e. having no voids. In order to maintain cigarettes in the path 12 when no reservoir 20 is attached to the unit 10 a separator in the form of a plate e.g. of plastics material, is inserted in a slot 54 at the bottom of the unit. A corresponding slot 56 for reception of another separator is provided on the reservoir so that the latter can be moved away from a unit 10 while it contains cigarettes. It should be noted that each reservoir 20 is provided with two inlet/outlet points, one at the bottom of the zig-zag path on each side, and that a slot 56*a* for reception of a separator is also provided at the right-hand end of the reservoir as viewed in FIG. 1 (see also FIG. 3). When filling an empty reservoir 20 from an elevator unit 10 some form of end closure device is preferably first inserted into the reservoir so that the advancing face of the stream of cigarettes is confined: thus the device is inserted in the path of the stream just behind the separator, which latter is then withdrawn allowing a stream to advance from the unit 10 into the reservoir, bounded by the trailing face or side of the closure device, which is demensioned to be moved by the conveyor bands of the reservoir. One form of end closure device for a reservoir including a zig-zag path is disclosed in the aforesaid U.S. Pat. No. 4,078,648.

A closure device 58 is shown at the right-hand end of the reservoir in FIG. 1 and in an intermediate position on band 30 in FIG. 2.

Referring now particularly to FIGS. 4 and 5, which show more details of the left hand end of a reservoir 20 connected to an elevator unit 10, a drive belt 60 from the motor 14 passes around a pulley 62 connected to a shaft 64 mounted at the bottom of the unit 10. The drive belt 60 takes the form of a timing belt which is positively engaged with its pulleys. It is preferred that the other drive belts and the belts which convey the cigarettes in the present apparatus should also be timing belts. The unit 10 includes vertical conveyor bands 66 and 68, which comprise timing belts having projections or ribs 70 at staggered positions on their opposed faces. The belt 66 passes around a bottom pulley 72 keyed to a shaft 74 which carries a further pulley 76. The pulley 76 is driven by means of a belt 78 passing around a pulley 80 connected to shaft 64.

The drive gear 16 is engaged with an identical gear 82 mounted in the unit 10 above the gear 16. The gear 82 is connected to a shaft 84 connected by means of a drive belt 86 for drive of the lower pulley 88 of the conveyor belt 68. It should be noted that the pulley 88 is in alignment with the shaft 64 but is not connected for rotation with it. The reversal of the drive to belt 68 by means of the gear 82 ensures that the direction of movement of the conveyor faces of the belts 66 and 68 is the same.

The drive belt 78 for shaft 74 also passes around a pulley 90, of reduced diameter relative to the drive pulley 80, connected to a shaft 92 on which are mounted two further axially spaced pulleys 94. These pulleys 94 form the apices of a triangular path for belts 96 and 98 also including idler pulleys 100. The belts 96, 98 guide the cigarettes in path 12 around the bottom corner of the unit 10. Neither of the belts 96, 98 is provided with ribs and the pulleys 100 are freely rotatable so that some degree of lateral movement of the belts is allowed across the corner.

The primary gear 16 is shown engaged with a drive gear 18 for a mobile reservoir 20. The path of a stream of cigarettes passing between the unit 10 and the reservoir 20 is defined by upper and lower dead plates 55 and 57 connected to the unit and reservoir respectively. There is a slight gap left between the dead plates 55 and 57 when the unit 10 and reservoir 20 are fully engaged, so that a pair of separator plates 154, 156 may be slid into place to separate the stream (as shown in FIG. 4). In order that the unit 10 and reservoir 20 may be separated when both are full of cigarettes, means, such as clips 102, 104, are provided for holding separator 154 to the elevator unit and separator 156 to the reservoir 20.

The drive gear 18 is connected to a drive shaft 106 rotatably mounted on the reservoir 20. A central main drive belt 108 passes around a pulley mounted on the shaft 106 and follows a path indicated in FIG. 4 to drive shafts on which the end pulleys of the conveyor bands 22, 24, 26, 28, 30 and 32 are mounted. The belt 108 also drives the pairs of corner bands **24*a* and 28*a* between the runs of conveyors 24 and 26, and 28 and 30 respectively. It can be seen that the upper quadrants of the corners of the zig-zag path are defined by curved plates 109. In addition the belts 108 passes around pulleys 110, 112 and 114 for the corner bands of the runs of conveyor on the downward zig-zag path of the adjacent side of the reservoir. Two such corners bands 116, together with the end of a conveyor band 118 are shown in FIG. 5**.

Referring now also to FIGS. 6 to 9, which show the opposite end of the reservoir of FIG. 4 from the same side, the conveyor band 24 passes around a pulley 120 mounted on a shaft which also carries a pulley 122 (FIG. 8) around which passes a further drive belt 124. The belt 124 follows a similar path and corresponds in function to the belt 108. As at the other end of the reservoir, pairs of corner belts **22*b*, 26*b* and 28*b* are provided, together with curved corner plates 109. The disposition of the various belts and bands are also shown in FIGS. 7, 8 and 9. FIG. 8 shows a conveyor band 126 and a pair of curved conveyor bands 126*b*, and FIG. 9 shows a conveyor band 128, from the far side of the reservoir 20**.

In operation, a stream of cigarettes introduced into a mobile reservoir is conveyed into the reservoir by means of the drive derived from motor 14. The leading end of the advancing stream is confined by an end closure device as previously mentioned. The stream is moved upwardly through the zig-zag path in the first side of the reservoir, until at the top it is passed onto the diagonally arranged band 32. The dimensions of the reservoir are such that the angle at which the band 32 is inclined to the other bands is sufficiently small to create little difficulty, either in the transfer of cigarettes to or from the band or in the drive to the pulleys of the band. However, in an alternative arrangement the diagonal band 32 could be replaced by a laterally flexible conveyor arranged so that it is parallel to the other bands at its ends. A suitable conveyor is described in British Pat. Specification No. 1,309,071, to which reference is directed for details.

After passing over the diagonal conveyor 32 (or a laterally flexible conveyor as just descriibed) the stream descends the zig-zag path on the other side of the reservoir, its leading end still being confined by the end closure device, which is positively held between the upper and lower bands defining the path for the stream. When the stream of cigarettes reaches the end of the lowermost run on its downward zig-zag path, so that the reservoir is full, the end closure device is allowed to be passed out of the reservoir and a separator inserted in the slot **56*a* to close off that end of the reservoir. Simultaneously a pair of separators may be inserted at the junction point between the reservoir and the elevator unit so that the reservoir may be moved away from temporary storage or for transport to another system where cigarettes are required. Another empty reservoir 20** may then be connected to the elevator unit.

It has been assumed that the elevator unit 10 has continued to supply cigarettes so that the reservoir becomes full. It will of course be realised that the supply of cigarettes from a unit 10 connected into a maker/-packer system could normally be intermittent and reversals could take place so that the elevator unit requires cigarettes to be fed upwards into the system. It is possible to operate the reservoir so that it may be reversed with the leading end of the stream of cigarettes at any position in the reservoir. Thus, when a sensor controlling the motor 14 of elevator unit 10 indicates that the system of which the unit forms a part requires cigarettes to be fed from the unit, the motor will be reversed so that the conveyor bands of both the unit and the reservoir are reversed to feed the required cigarettes. When operating a reservoir in this way, however, it is possible for some cigarettes to remain in the reservoir for long periods and for some degradation of these cigarettes to occur due to the frequent reversals and consequent passage around corners of the reservoir.

In an alternative mode of operation the system into which a reservoir of the present type is connected may be arranged to normally have a slight excess of cigarette supply so that feed to the reservoir through an elevator unit is unidirectional. A subsidiary reservoir permanently connected into the system can accommodate any short term variations in the rate of supply. Thus successive reservoirs are filled by the system and can be removed for storage or supply to another system where the supply is normally slightly deficient; this second system therefore can also preserve unidirectional flow through the reservoir. A single system could be operated in the two different modes at different times. The advantage of having access to a reservoir of unlimited capacity is still retained.

FIG. 10 shows a system including a conveyor 200 for moving a stream of cigarettes from one or more cigarette making machines to packing machine hoppers 202, 204. There are two elevator units 206, 208 connected to the conveyor 200 under control of sensors 210, 212 respectively. A mobile reservoir 214 is shown connected to the elevator 206 and another reservoir 216 is shown connected to the elevator 208. The reservoirs 214, 216 are shown as identical to the reservoir 20. However, they need not be double sided; in other words each reservoir could comprise a single zig-zag path with an end stop at the top. In a further possible arrangement one or both reservoirs could be arranged to receive or supply cigarettes on its upper run rather than on its lower run, so that the zig-zag path descends from the access point rather than ascending.

Returning now to FIG. 10 the elevators 206, 208 and reservoirs 214, 216 could be driven by a single motor 218 under separate control, as by sensors 210, 212 respectively. One way of operating the system of FIG. 10, when the makers are consistently producing more cigarettes than the packers 202, 204 can accept, is to use the reservoir 214 to accept the mean excess of cigarettes in the conveyor 200 and to use the reservoir 216 as a reversible permanent reservoir. Thus successive reservoirs are filled at the elevator 206 while the reservoir 216 remains as a reversible buffer, principally for use while reservoirs are being changed at the elevator 206. If the system moves from a state of surplus to a state of deficiency, i.e. the makers fail to make enough cigarettes for the packers, this condition can be temporarily dealt with by supply, either from the reservoir 214 if it is partly filled, or from the buffer reservoir 216. As soon as a certain minimum fill level is reached in the reservoir 216 a signal will be given to indicate the need for a full reservoir to be supplied to the elevator 206. In an analogous way, if the buffer reservoir 216 fills to beyond a certain level a signal can indicate that an empty reservoir is needed at elevator 206.

The use of a mobile reservoir as a buffer store preserves flexibility for emergency use but for most purposes a permanent reservoir could be used in a similar way. Suitable reservoirs are described in U.S. Pat. No. 4,078,648 and also in British Patent Specifications Nos. 1,299,174 and 1,299,175. An example of a helical reservoir, as described in said specifications, in use in a system of the present type is shown in FIG. 11. In this Figure two makers 220, 222 are shown supplying cigarettes to a conveyor 224 which carries them in stack formation towards packer hoppers 226, 228. Also connected to the conveyor 224 are an elevator unit 230 and a helical reservoir 232. A chute **224*a* may be used to connect the conveyor 224 and reservoir 232 to the hoppers 226, 228. As before a mobile reservoir 234 may be connected to the elevator 230 for drive by a motor 235. The flow of cigarettes to or from the helical reservoir 232 is under control of sensor 238. The motor 235 may be controlled by a control unit which not only takes into account a signal derived from sensor 236 at the top of the elevator 230 but also the state of fill of the reservoir 232 and the speed of the associated makers and/or packers. Operation of the system of FIG. 11 is otherwise similar to that of FIG. 10, full or empty reservoirs 234 being connected to the elevator 230** according to the operating state of the system.

It has already been mentioned that it is preferred to operate a system employing the present mobile reservoir so that the cigarettes are fed into and out of the reservoir in a unidirectional path. An operation in which any direction changes in the reservoir are inhibited can readily be achieved in the system of FIG. 11, using the helical reservoir 232. Thus, if the makers normally supply an excess of cigarettes so that the reservoir 234 is normally steadily filled, a temporary maker stoppage can be compensated for by the helical reservoir, filling of the reservoir 234 being temporarily suspended. Similarly, in a system in which excess cigarettes are required by the packers, a temporary stoppage of the packers can be overcome by stopping the feed out from the mobile reservoir and allowing the helical reservoir to accept the temporary excess from the makers.

The mobile reservoirs described so far have been similar to the reservoir 20 of FIGS. 1 to 9. It is possible to have single sided reservoirs, i.e. a single zig-zag path, if reduced capacity can be tolerated. In this case normally there would be only one inlet/outlet position for the cigarettes, an end stop being provided at the other end of the zig-zag path. It is of course possible to have more than two zig-zag paths in a single unit with appropriate cross-overs. Alternatively a single mobile unit may include several independent parallel zig-zag paths, each with its own separate inlet/outlet position so that the unit would have to be moved sideways to bring another path into engagement with the elevator.

A convenient size for a mobile reservoir unit is about 6 ft. by 3 ft. The height of the stream of cigarettes is preferably no more than twelve cigarettes to avoid an excessively sloping upper surface when tipped cigarettes are used (although some compensation at the corners such as is disclosed in U.S. Pat. No. 4,078,648 may be used). With this height of stream the capacity of a double-sided reservoir (e.g. unit 20) would be around 32,000 cigarettes.

In the mobile reservoir unit 20 of FIGS. 1 to 9 there is an end closure device 58 which is similar to that disclosed in U.S. Pat. No. 4,078,648 and which comprises a cylinder of cigarette length and having a diameter just exceeding the distance between the conveyor bands of the zig-zag path through the reservoir. The cylinder can be inserted in an empty reservoir prior to filling and is preferably coated with a thick layer of foam plastics material or with a deep pile carpet. If the cylinder is adjacent the inlet to the reservoir, removal of the separator at the base of the elevator unit will cause the cigarettes to come into contact immediately with the roller and subsequent movement of the cigarettes and roller will be controlled. It should be noted that with the use of ribbed conveyor bands in the reservoir the cylinder remains captive between staggered ribs on the upper and lower bands of each horizontal run. Movement upward of the advancing cigarette stream, preceded by the cylinder is straightforward. On the downward zig-zag path, after the diagonal traverse, the foam coating or the long hairs of the carpet covering prevent the cylinder from falling around the corners of the path. As the reservoir becomes filled the movement of the lower conveyors is such that the cylinder plus a few cigarettes move past the exit gate, comprising a slot for a separator, before the separator can be inserted. After insertion of the separator the cylinder and few loose cigarettes are removed by hand, the cigarettes being assembled for insertion into a convenient packer hopper and the cylinder being clipped onto a holder on the side of the reservoir unit.

Part of a reservoir unit 240 is shown in FIG. 12 during filling of the reservoir. The leading end of a stream of cigarettes 242 is terminated by a cylinder 244 having a deep pile carpet covering 246. It should be noted that in this reservoir the corner conveyors 248 are arranged to provide drive in the upper quadrant of a corner; this is not essential but may provide better control than fixed guide plates.

Prior to connecting a filled reservoir to an elevator for supply of its contents to the elevator system it is preferred to insert an end closure device to retain the advancing rear end of the cigarette stream in the reservoir. When used to follow a stream of cigarettes in the emptying of a reservoir it is important that an end closure device should be gripped positively so that it follows the stream and urges it around the corners. Preferred devices 250 and 251 for achieving this are shown in FIGS. 14 and 15 and comprise rectangular end plates 252 connected by resilient material in concertina fashion to provide lateral flexibility. The outer sides 253 which are designed for contact with the conveyor bands of a reservoir, are preferably covered with cloth or zig-zag paper-like material whereas the resilience may be provided by spring metal 254. Instead of the devices 250, 251 a rectangular sponge could be used.

Use of an end closure device 250 is shown in FIG. 13, which illustrates part of the lower two runs of a modified reservoir 260. The lower run comprises upper and lower conveyors 262, 264 respectively. Assuming that the reservoir is full and was filled by connection of the conveyors 262, 264 to an elevator the reservoir will be emptied from its other end for unidirectional operation so that an end closure device for emptying will be required for feeding between the conveyors 262, 264. In order to readily achieve insertion of such a device in these circumstances a pair of hinged bands 266, normally in the position shown in chain-dotted lines are moved into the position shown in FIG. 13. The device 250 is fed between the bands 266 until its leading face is adjacent the separator which lies in plane 268. The separator can then be withdrawn as soon as the reservoir is connected to an elevator for emptying as the leading face of the device 250 will form an end wall for the stream as it is conveyed by the conveyors 262, 264. As shown also in FIG. 13 the device is easily and positively driven around corners including an upper curved plate 270, since the leading portion of the device is gripped by the pair of conveyors 272, 262 before the trailing portion has become disengaged from the curved corner bands 274. In fact the engagement of the inner side of a device 250 or 251 should be sufficient to drive it upwards and around a corner. When the reservoir is almost empty a separator is inserted to close off the elevator into which the reservoir is connected and the closure device removed (along with any few remaining loose cigarettes) before finally inserting the reservoir separator. As before the closure device may be clipped to the reservoir in readiness for further use.

While devices such as that shown in FIGS. 14 and 15 have been described in use for emptying a reservoir and a cylinder 244 has been desired for use in filling a reservoir there is in principle no reason why either type of device should not be used in either mode of operation so that only one device is required for each reservoir.

Another form of mobile reservoir 300, for receiving and storing batches of cigarettes is shown in FIGS. 16 to 18. The reservoir incorporates a conveyor 318 supported on a mobile frame 340. The reservoir is adapted to receive batches from (or supply batches to) a static conveyor system including an endless band conveyor 310 which has a substantially horizontal upper run supporting a stream 312 consisting of a stack of parallel cigarettes. The conveyor 310 is arranged to be open ended and internally supported at that end so that a mobile reservoir can be moved on and off the conveyor in a longitudinal direction. The stream 312 is divided into batches on the conveyor 310 by regularly-spaced divider plates 314 carried by the conveyor. The divider plates are movable relative to the surface of the conveyor 310 and may be successively projected into a continuous stream to form batches or withdrawn to reform a continuous stream, at a position generally to the right of the part of the apparatus shown in FIG. 16, in any convenient way, for example as disclosed in U.S. Pat. No. 3,967,740 or U.S.A. patent application Ser. No. 646,845.

Alternatively batches may be formed by feeding a stream of cigarettes downwards onto a conveyor having fixed divider plates, as disclosed for example in U.S.A. patent application Ser. No. 648,926.

In one mode of operation the conveyor 310 moves batches of cigarettes towards a transfer position 316. The movement of the conveyor 310 is intermittent and in each stage the conveyor is moved through a distance equal to the spacing between successive divider plates so that batches may be successively conveyed to the transfer position 316 and the conveyor then stopped. The transfer position 316 is defined by the intersection of the upper run of the conveyor 310 with the conveyor 318 of the reservoir. The conveyor 318 comprises substantially vertical opposed parallel endless bands **318*a*, 318*b* which are spaced by a distance slightly greater than the length of the cigarettes on the conveyor 310. When the reservoir is moved into position over the conveyor 310 the bands 318*a*, 318*b* are on opposite sides of the conveyor 310 and the width of the bands 318*a*, 318*b* is approximately equal to the length of a batch on the conveyor 310 (but could be sufficiently wide to accommodate several batches). As can be seen from FIG. 17 the width of the first conveyor 310 is somewhat less than the lengths of the cigarettes. Each of the bands 318*a*, 318*b* carries spaced inwardly-directed rails or ledges 320 which are sufficiently wide to be able to support the cigarettes at their ends but not wide enough to interfere with the conveyor 310. The spacing between the ledges 320 on the bands 318***a*, 318*b* is slightly greater than the height of a batch on the conveyor 310.

In said one mode of operation the reservoir conveyor 318 comprising bands 318*a*, 318*b* is movable intermittently in stages through a distance equal to the spacing between successive ledges 320. Thus batches are successively supplied by the static conveyor 310 to the transfer position 316 so that the batches rest on the conveyor 310 between ledges on the bands 318*a*, 318*b*. Whilst the conveyor 310 is moving the conveyor 318 is stationary; as soon as the conveyor 310 stops, having delivered a batch to the transfer position, the conveyor 318 is started and operates to move the batch upwards, from the position 312*a* to 312*b* as shown in FIG. 17. In this manner batches supplied to the transfer position 316 are successively removed by the conveyor 318 for storage within the reservoir.

The endless bands 318*a* and 318*b* of the reservoir conveyor cooperate with four relatively fixed corner guides 322 which serve to support the ends of the batches on the second conveyor as shown in FIG. 18. The portions of the guides 322 which project inwardly are narrower than the divider plates 314 so that cigarettes are not damaged by the edges 322*a* (FIG. 16) as the conveyor 318 lifts the batches.

The static conveyor 310 and the reservoir conveyor 318 are reversible so that batches may be returned to the conveyor 310 from the reservoir and subsequently moved away to the right (as viewed in FIG. 16). During return of a batch to the conveyor 310 by downward movement of the conveyor 318 the divider plates 314, which have tapered upper ends adapted to be projected into a continuous stream, take over from the guides 322 to confine the batch on the conveyor 310. In systems where cigarettes or the like are moved in a stream such as the stream 312 between one or more makers and one or more packers the conveyor 310 can be linked to the main stream to provide access to a buffer store formed by conveyor 318. Sensors capable of operating such a system automatically are described in British Pat. Specification No. 1,299,174.

The space between the bands 318*a*, 318*b*, which constitutes the store of the reservoir, could accommodate 20,000 cigarettes in batches of 1200 in a height of about six feet. With such an arrangement control means would prevent the reservoir from accepting any more batches when it had reached the limit of its capacity.

Instead of comprising a pair of endless bands 318 the reservoir conveyor could take the form of a rectangular tray open at opposite ends and provided with appropriately spaced internal ledges, the tray being vertically movable within a mobile supporting structure such as frame 340.

The mobile reservoirs described with reference to FIGS. 1 to 15 are adapted for connection to a conveyor (usually an elevator unit) forming part of a conveyor system linking one or more cigarette making machines to one or more cigarette packing machines. The mobile reservoirs which receive and supply the cigarettes in batches may be used to adjust the net flow between the makers and packers and may supply cigarettes to or accept cigarettes from a conveyor system linking the makers and packers in the same way as the reservoirs previously described. In particular, the drive for the reservoirs may be derived from a drive output associated with the system conveyor so that each reservoir is automatically connected to the drive output as it is moved into engagement with the conveyor. The conveyor 310 could comprise an extension of an elevator unit leading to the conveyor system and mobile reservoirs can be moved on and off the conveyor in a direction parallel to the conveyor as previously described.

A mobile reservoir unit 400 for batches of cigarettes and movable into engagement with a system batch conveyor 402 in a direction transverse to the conveyor is shown in FIG. 19. The conveyor 402 is similar to the conveyor 310; the unit 400 comprises a mobile supporting structure 404 having wheels 406 and carrying first and second batch conveyors 408, 410, which are similar to conveyor 318 except that the supports for the batches comprise hinged L-shaped rails 412. These rails can hang down below the lower pulleys of the conveyors 408, 410 to lift or lower a batch from or onto the conveyor 402, thereby allowing the lower pulleys to be at a level above that of the conveyor 402 so that the conveyors 408, 410 can be moved sideways over the conveyor 402. Before any such sideways movement the conveyors 408, 410 must be adjusted so that the rails 412 also are above the level of conveyor 402. The stores defined by conveyors 408, 410 are filled and/or emptied separately by appropriate sideways movement to bring one or other of the conveyors into position over the system conveyor 402. This sideways movement may be achieved by bodily movement of the structure 404 or, alternatively, the conveyors 408, 410 may be supported so that they are movable sideways relative to the structure 404. Drive for the conveyors 408, 410 may be by separate motors or may be derived from an output associated with the system conveyor 402 through a drive chain in the structure 404. Apart from the sideways movement of the conveyors 408, 410 over the system conveyor (which allows the latter to be continuous), operation and use of the unit 400 is analagous to that of the unit described with reference to FIGS. 16 to 18.

We claim:

1. A conveyor system for rod-like articles, including a reservoir, the reservoir including means for receiving a multi-layer stream of rod-like articles delivered substantially horizontally from a supply in a direction transverse to the lengths of the articles; conveyor means forming a part of the reservoir for conveying the articles in a multi-layer formation within the reservoir; means for supporting the reservoir so that it is mobile; means for storing and retaining the articles in the reservoir so that it may be separated and moved away from said supply including means for confining a leading end of the stream delivered into the reservoir during conveyance by said conveyor means; and drive means for said conveyor means, said drive means including drive connecting means movable with said reservoir and adapted to be releasably connected to stationary output drive means associated with said supply, whereby said conveyor means is driven when said reservoir is in an operative position with respect to said supply.

2. A conveyor system as claimed in claim 1, wherein the conveyor means is reversible so as to be capable of feeding the rod-like articles from the reservoir back to the supply.

3. A conveyor system as claimed in claim 1, wherein the conveyor means is arranged to move and store said rod-like articles as a continuous stream in the reservoir.

4. A conveyor system as claimed in claim 3, wherein said confining, means includes an end closure device movable with said conveyor means for bounding the end of a stack of rod-like articles in the reservoir.

5. A conveyor system as claimed in claim 4, further comprising subsidiary conveyor means for inserting the end closure device into the reservoir.

6. A conveyor system as claimed in claim 3, wherein the conveyor means defines a continuous helical path for the rod-like articles.

7. A conveyor system as claimed in claim 3, wherein the reservoir includes at least one inlet through which the stream of rod-like articles is received, the retaining means including closure means for said inlet.

8. A conveyor system as claimed in claim 7, wherein the closure means comprises a separator plate adapted for insertion into a stream of rod-like articles.

9. A conveyor system as claimed in claim 3, wherein the conveyor means of the reservoir includes a number of conveyors defining a zig-zag path extending substantially in a constant plane normal to the axis of the rod-like articles.

10. A conveyor system as claimed in claim 9, comprising two substantially vertical zig-zag conveyor paths arranged alongside one another.

11. A conveyor system as claimed in claim 10, including a diagonal connecting conveyor connecting said two paths to form a continuous conveyor path.

12. A conveyor system as claimed in claim 9, wherein said confining means includes an end closure device movable with said conveyor means for bounding the end of a stack of rod-like articles in the reservoir, wherein said device is adapted to pass around the curves of said zig-zag path.

13. A conveyor system as claimed in claim 1, including at least two separate openings for transfer of rod-like articles to or from the reservoir, wherein the conveyor means forms a continuous path for rod-like articles between said openings.

14. A conveyor system as claimed in claim 1, wherein the receiving means is adapted to receive the rod-like articles in batches each comprising a stack of rod-like articles.

15. A conveyor system as claimed in claim 14, wherein the conveyor means is arranged to move and store the rod-like articles in separate batches.

16. A conveyor system as claimed in claim 15, wherein the conveyor means comprises opposed endless conveyors provided with spaced ledges for supporting each batch.

17. A conveyor system as claimed in claim 16, including retaining means for the batches in the form of guides which support the ends of a batch on the conveyor means, the guides for the leading end of a batch constituting said confining means.

18. A conveyor system as claimed in claim 1, including locating means adapted to position the reservoir relative to a supply.

19. A conveyor system for rod-like articles, including at least one reservoir, the reservoir including means for receiving a multi-layer stream of rod-like articles, conveyor means forming a part of the reservoir for conveying the articles as a multi-layer stream within the reservoir, means for supporting the reservoir so that it is mobile, means for storing and retaining the articles in the reservoir; delivery means for moving a multi-layer stream of rod-like articles substantially horizontally into said reservoir in a direction transverse to the lengths of the articles; locating means for locating and guiding a reservoir into position for transfer of rod-like articles between the conveyor means of the reservoir and the delivery means, said reservoir being arranged to receive articles from the delivery means without substantial change of the formation of the articles; and drive means for said conveyor means of the reservoir, said drive means including drive connecting means movable with said reservoir and adapted to be releasably connected to a stationary output drive means associated with said delivery means whereby said reservoir conveyor means is driven when said reservoir is in an operative position with respect to said delivery means.

20. A conveyor system as claimed in claim 19, wherein the output means of the delivery means controls the reservoir conveyor means.

21. A conveyor system as claimed in claim 20, wherein the output means comprises a drive means connected to the drive means for said reservoir conveyor means.

22. A conveyor system as claimed in claim 19, wherein the delivery means is reversible.

23. A conveyor system as claimed in claim 19, further including closure means for blocking said delivery means to prevent outflow of rod-like articles when a reservoir is not connected to the delivery means.

24. A conveyor system as claimed in claim 19, wherein the delivery means comprises an elevator for rod-like articles.

25. A conveyor system as claimed in claim 19, wherein the delivery means comprises a conveyor having separators for dividing a stream of rod-like articles on the conveyor into batches.

26. A conveyor system as claimed in claim 19, comprising a plurality of delivery means, a sensor associated with each delivery means, and drive means for each delivery means, said drive means being controlled by the associated sensor.

27. A conveyor system as claimed in claim 19, wherein a fixed permanent reversible reservoir is connected to the system.

28. A conveyor system as claimed in claim 27, wherein the delivery means is at least partly controlled by a signal derived from the permanent reservoir.

29. A conveyor system as claimed in claim 1, wherein said conveyor means includes means for moving the rod-like articles in a generally upward direction.

30. A conveyor system as claimed in claim 1, wherein said confining means comprises a separable end closure device.

31. A conveyor system as claimed in claim 19, including a supply means for supplying rod-like articles to the reservoir, wherein means are provided for selectively reversibly driving the supply means and the conveyor means such that the reservoir is capable of moving and storing the rod-like articles and selectively returning the rod-like articles to the supply means.

* * * * *